US007813682B2

(12) United States Patent
Yokoi

(10) Patent No.: US 7,813,682 B2
(45) Date of Patent: Oct. 12, 2010

(54) IMAGE FORMING APPARATUS THAT SMOOTHLY CONVEYS TRANSFER MEDIUM WHILE SUPPRESSING PRE-TRANSFER

(75) Inventor: Katsuyuki Yokoi, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 792 days.

(21) Appl. No.: 11/371,899

(22) Filed: Mar. 10, 2006

(65) Prior Publication Data

US 2006/0204288 A1 Sep. 14, 2006

(30) Foreign Application Priority Data

Mar. 11, 2005 (JP) ..... 2005-069722

(51) Int. Cl.
*G03G 15/01* (2006.01)

(52) U.S. Cl. ..... 399/299

(58) Field of Classification Search ..... 399/299
See application file for complete search history.

(56) References Cited

U.S. PATENT DOCUMENTS 6,850,726 B1 2/2005 Mizuno et al.
6,938,351 B2 * 9/2005 Kobayashi et al. ..... 399/313 X

FOREIGN PATENT DOCUMENTS

JP 6-95536 4/1994
JP 9-222810 8/1997
JP 9-292779 11/1997
JP 2000-347516 A 12/2000
JP 2001-22208 A 1/2001
JP 2001-125392 A 5/2001
JP 2001-296760 10/2001
JP 2002-148898 5/2002
JP 2003-91133 3/2003
JP 2003-98800 4/2003
JP 2003-133419 5/2003
JP 2003-241476 A 8/2003
JP 2003-241482 8/2003

(Continued)

OTHER PUBLICATIONS

CN Office Action dtd Aug. 29, 2008, CN Appln. 200610059560.X.

(Continued)

*Primary Examiner*—David M Gray
*Assistant Examiner*—Erika Villaluna
(74) *Attorney, Agent, or Firm*—Banner & Witcoff, Ltd.

(57) ABSTRACT

An image forming apparatus includes an apparatus main body and a plurality of sets each including a photosensitive member and a transfer member. The plurality of sets is disposed in a linear arrangement in the apparatus main body. The photosensitive member and the transfer member of each set sequentially interpose a transfer medium therebetween, thereby sequentially transferring a developer image borne on each photosensitive member onto the transfer medium. A contact distance is defined for each set. The contact distance is a distance from a contact start position at which the photosensitive member starts contacting the transfer medium to a contact end position at which the photosensitive member separates from the transfer medium. The contact distance is greatest for the set farthest downstream in a conveying direction for conveying the transfer medium.

10 Claims, 6 Drawing Sheets

FOREIGN PATENT DOCUMENTS

| | | | |
|---|---|---|---|
| JP | 2003-241545 | A | 8/2003 |
| JP | 2003-280409 | | 10/2003 |
| JP | 2003-295578 | | 10/2003 |
| JP | 2004-333677 | A | 11/2004 |
| WO | WO 02/056118 | | 7/2002 |

OTHER PUBLICATIONS

JP Office Action dtd Sep. 2, 2008, JP Appln. 2005-069722.
JP Office Action dtd Apr. 16, 2009, JP Appln. 2005-069722, English Translation.

* cited by examiner

IMAGE FORMING APPARATUS THAT SMOOTHLY CONVEYS TRANSFER MEDIUM WHILE SUPPRESSING PRE-TRANSFER

CROSS REFERENCE TO RELATED APPLICATIONS

This application claims priority from Japanese Patent Application No. 2005-069722 filed Mar. 11, 2005. The entire content of the priority application is incorporated herein by reference.

TECHNICAL FIELD

The invention relates to an image forming apparatus, and more specifically to a tandem-type image forming apparatus.

BACKGROUND

One type of image forming apparatus well known in the art that employs an electrophotographic technology is a tandem-type image forming apparatus. This type of image forming apparatus includes a developing roller, a photosensitive member, and a transfer roller for each of the colors yellow, magenta, cyan, and black, for example. During image formation, each developing roller supplies developer in each respective color onto each respective photosensitive member to form a developer image in the respective color. Each developer image is transferred sequentially onto a sheet of paper conveyed along the photosensitive members.

SUMMARY

One such tandem-type image forming apparatus is illustrated in FIG. 1A. As shown in the drawing, the image forming apparatus includes a photosensitive member 51 and a transfer roller 53. A sheet 52 of paper is conveyed between the photosensitive member 51 and the transfer roller 53 to the right in FIG. 1A. The image forming apparatus is configured so that a contact start position X at which the photosensitive member 51 initially contacts the sheet 52 is identical to the contact end position Y at which the photosensitive member 51 separates from the sheet 52. The photosensitive member 51 bears a layer of developer 54 on the surface thereof. With this configuration, it is possible that a phenomenon called pre-transfer might occur in which an electric field E produced in the transfer roller 53 causes the developer 54 borne on the photosensitive member 51 to scatter onto the sheet 52 prior to the contact start position X (contact end position Y), that is, before the sheet 52 contacts the photosensitive member 51. This phenomenon can degrade the quality of image formation.

Japanese Patent Application Publication No. 6-95536 discloses a technique for offsetting the transfer member from the respective photosensitive member downstream in the paper-conveying direction, as shown in FIG. 1B. With this configuration, the sheet 52 comes into contact with the photosensitive member 51 (contact start position X) upstream of the contact end position Y that is affected by the electric field E produced in the transfer roller 53, thereby suppressing the scattering of the developer 54 and preventing pre-transfer.

However, in the structure of Japanese Patent Application Publication No. 6-95536, the photosensitive members and transfer rollers in each set are offset (shifted) from each other uniformly by the same offset distance. As a result, the entire paper-conveying path undulates, hindering smooth paper conveyance and potentially affecting the quality of image formation. The conveying operation is particularly difficult for thick paper.

In view of the foregoing, it is an object of the invention to provide an image forming apparatus capable of smoothly conveying a transfer medium while suppressing pre-transfer.

In order to attain the above and other objects, the invention provides an image forming apparatus. The image forming apparatus includes an apparatus main body and a plurality of sets each including a photosensitive member and a transfer member. The plurality of sets is disposed in a linear arrangement in the apparatus main body. The photosensitive member and the transfer member of each set sequentially interpose a transfer medium therebetween, thereby sequentially transferring a developer image borne on each photosensitive member onto the transfer medium. A contact distance is defined for each set. The contact distance is a distance from a contact start position at which the photosensitive member starts contacting the transfer medium to a contact end position at which the photosensitive member separates from the transfer medium. The contact distance is greatest for the set farthest downstream in a conveying direction for conveying the transfer medium.

BRIEF DESCRIPTION OF THE DRAWINGS

Illustrative aspects in accordance with the invention will be described in detail with reference to the following figures wherein.

DETAILED DESCRIPTION

First Embodiment

Figure 1A:
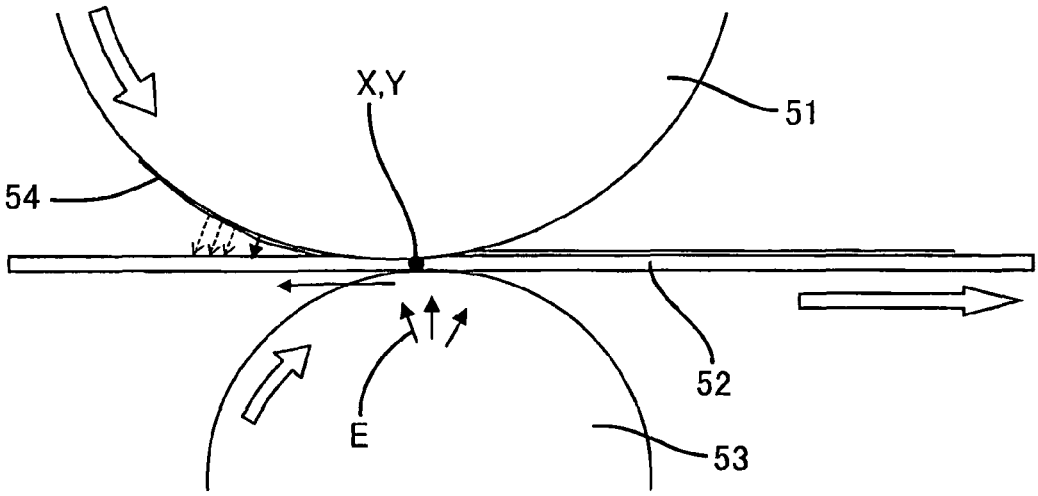
FIG. 1A is an explanatory diagram illustrating a pre-transfer effect.
Figure 1B:
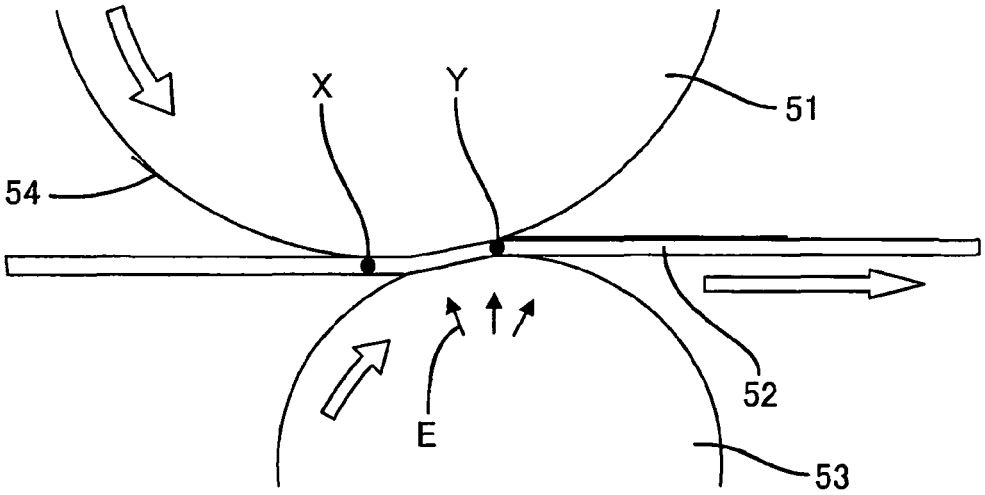
FIG. 1B is an explanatory diagram in which a transfer member is offset from a photosensitive member downstream in a paper-conveying direction.

An image forming apparatus according to a first embodiment of the invention will be described with reference to FIGS. 1B and 2.

In the following description, the expressions "front", "rear", "upper", and "lower" are used to define the various parts when the image forming apparatus is disposed in an orientation in which it is intended to be used.

1. General Structure of a Printer

Figure 2:
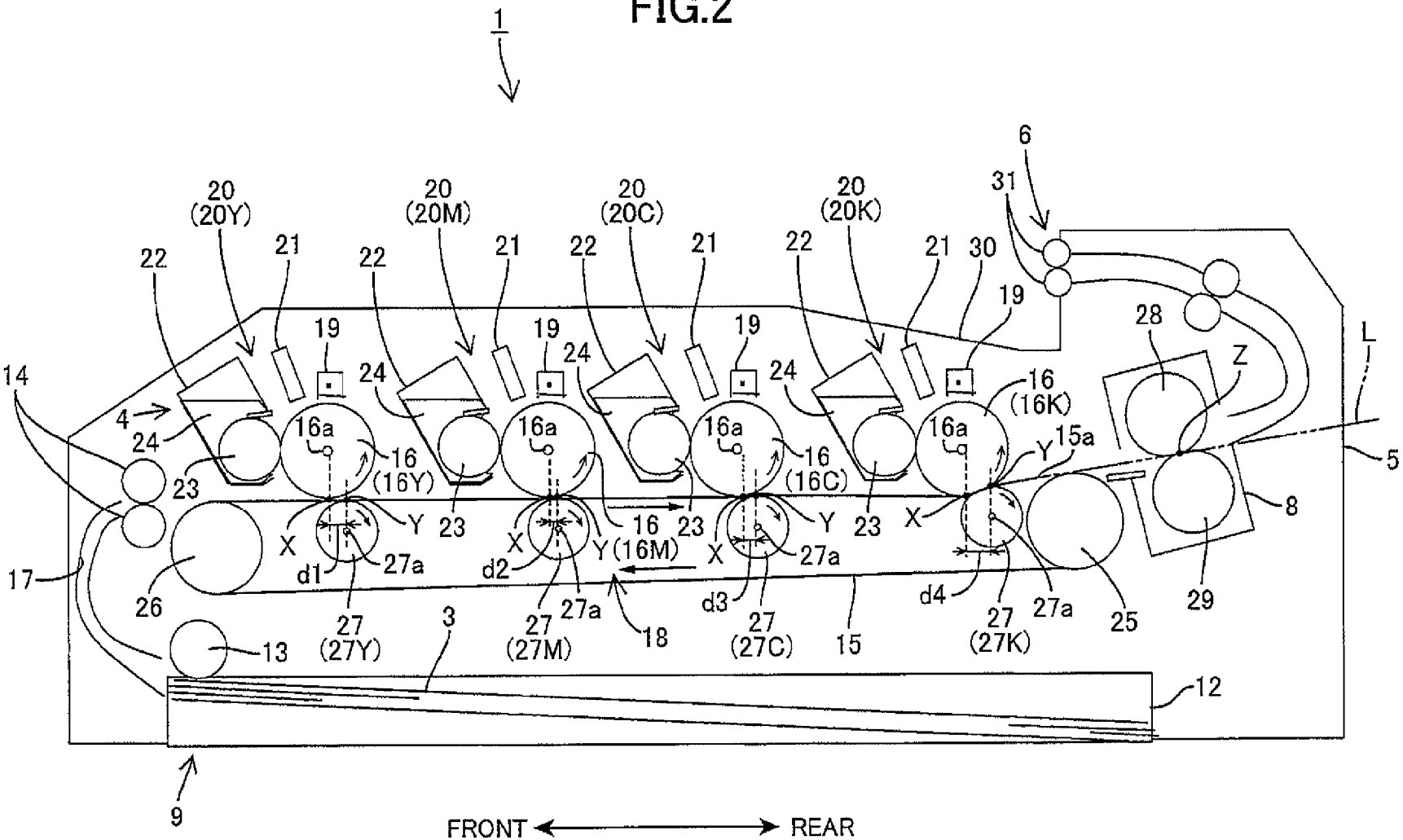
FIG. 2 is a vertical cross-sectional view of a printer according to a first embodiment of the invention.

FIG. 2 is a vertical cross-sectional view showing the general structure of a printer 1 according to the first embodiment.

As shown in FIG. 2, the printer 1 is a transverse tandem-type color laser printer having four image forming units 20 described later that are horizontally juxtaposed. The printer 1 includes a main casing 5 and, within the main casing 5, a paper supply unit 9 for supplying a recording paper 3 into the main casing 5, an image forming unit 4 for forming images on the recording paper 3 supplied from the paper supply unit 9, a discharge unit 6 for discharging the sheets of recording paper 3 after an image has been formed thereon, and the like.

(1) Paper Supply Unit

The paper supply unit 9 includes a paper tray 12 detachably mounted in a lower section of the main casing 5 and capable of being inserted into and removed from the main casing 5 through a front side (left side in FIG. 2) thereof; a feeding roller 13 disposed above one end (the left end in FIG. 2) of the paper tray 12; and a pair of conveying rollers 14 disposed above the feeding roller 13 and downstream of the feeding roller 13 with respect to a paper-conveying direction for conveying the recording paper 3.

When sheets of the recording paper 3 are stacked in the paper tray 12 and the feeding roller 13 rotates, the topmost sheet of the recording paper 3 is fed by the feeding roller 13 to the conveying rollers 14 one sheet at a time. A conveying belt 15 disposed on the downstream side of the conveying rollers 14 subsequently conveys the recording paper 3 sequentially past photosensitive drums 16.

A guide member 17 links the feeding roller 13 to the conveying rollers 14 vertically. The guide member 17 is substantially U-shaped so that the recording paper 3 conveyed by the feeding roller 13 is initially conveyed in a leftward direction in FIG. 2 and subsequently inverted and conveyed in the rightward direction. The recording paper 3 is then conveyed between the conveying belt 15 and the photosensitive drums 16 in sequence.

(2) Image Forming Unit

The image forming unit 4 disposed in the center region of the main casing 5 includes four image forming units 20Y, 20M, 20C, and 20K for forming images, a transfer unit 18 for transferring the images formed by each image forming unit 20 onto the recording paper 3, and a fixing unit 8 for fixing the images transferred onto the recording paper 3 with heat and pressure.

Each image forming unit 20 is configured of the photosensitive drum 16 and around the periphery of the photosensitive drum 16, a charger 19 for charging the surface of the photosensitive drum 16, a scanning unit 21 for forming an electrostatic latent image on the surface of the photosensitive drum 16, and a developer cartridge 22 for depositing toner on the surface of the photosensitive drum 16 to form a toner image thereon.

The charger 19 is a positive-charging Scorotron charger having a charging wire formed of tungsten or the like from which a corona discharge is generated. The charger 19 functions to charge the entire surface of the photosensitive drum 16 with a uniform positive polarity.

Each scanning unit 21 includes a laser-generating unit for generating a laser beam, lenses, and the like (none of which components are shown in the drawings) for forming electrostatic latent images on the surface of the photosensitive drum 16. With this construction, the laser-generating unit of the scanning unit 21 emits a laser beam that is irradiated on the photosensitive drum 16 in a scanning motion for forming an electrostatic latent image on the surface thereof.

The developer cartridge 22 includes a casing, within which are provided a toner hopper 24, a supply roller (not shown), and a developing roller 23.

The toner hopper 24 is a space formed inside the casing of the developer cartridge 22. Each toner hopper 24 accommodates a developer of one of the colors yellow (Y), magenta (M), cyan (C), and black (K). Specifically, the four developer cartridges 22 described above accommodate developer in the order of colors yellow, magenta, cyan, and black with respect to the paper-conveying direction (left-to-right in FIG. 2). In the following description, the letters Y, M, C, and K may be appended to reference numerals of the components corresponding to the color of developer thereby. In other words, the image forming unit 20 may be labeled 20Y, 20M, 20C, and 20K; the photosensitive drum 16 may be labeled 16Y, 16M, 16C, and 16K; and a transfer roller 27 described later may be labeled 27Y, 27M, 27C, and 27K according to the color of developer used thereby.

The supply roller is disposed below the toner hopper 24 and includes a metal roller shaft covered by a roller portion that is formed of an electrically conductive sponge material. The supply roller confronts and contacts the developing roller 23 at a nip point and is rotatably supported in a direction opposite the rotating direction of the developing roller 23 at the nip point.

The developing roller 23 is rotatably disposed to the side of the supply roller and confronts and contacts the supply roller. The developing roller 23 is configured of a metal roller shaft covered by a roller portion that is formed of a resilient material, such as an electrically conductive rubber material.

The transfer unit 18 is disposed in the main casing 5 so as to confront the photosensitive drums 16 on the opposite side of the developer cartridges 22. The transfer unit 18 includes a drive roller 25, a follow roller 26, the conveying belt 15 looped around the drive roller 25 and follow roller 26, and the transfer rollers 27.

The follow roller 26 is disposed above the feeding roller 13 and the front (to the left in FIG. 2) of the photosensitive drum 16Y. Here, the photosensitive drum 16Y belongs to the image forming unit 20Y positioned farthest upstream with respect to the paper-conveying direction (leftmost in FIG. 2). The drive roller 25 is disposed diagonally forward of and below the fixing unit 8 and rearward of the photosensitive drum 16K. Here, the photosensitive drum 16K belongs to the image forming unit 20K positioned farthest downstream with respect to the paper-conveying direction.

The conveying belt 15 is looped around the drive roller 25 and follow roller 26 such that the outer surface of the conveying belt 15 confronts and contacts the photosensitive drum 16 in each image forming unit 20.

When the drive roller 25 is driven to rotate, the follow roller 26 follows the rotation of the drive roller 25. At this time, the conveying belt 15 looped around the drive roller 25 and follow roller 26 moves circularly in the clockwise direction in FIG. 2 so that the outer surface of the conveying belt 15 moves in the same direction as the outer surfaces of the photosensitive drums 16 at the point of contact between the conveying belt 15 and the photosensitive drums 16.

The transfer rollers 27 are disposed inside the loop of the conveying belt 15 at positions confronting each of the photosensitive drums 16 via the conveying belt 15. The transfer roller 27 is configured of a metal roller shaft covered with a roller portion that is formed of a resilient member, such as an electrically conductive rubber material.

The transfer roller 27 is capable of rotating in the clockwise direction of FIG. 2 so that the outer surfaces of the transfer rollers 27 move in the same direction as the conveying belt 15 at the point of contact therewith. During a transfer operation, a power supply applies a predetermined voltage through constant current control for producing an appropriate transfer bias between the transfer roller 27 and the photosensitive drum 16 for causing developer borne on each photosensitive drum 16 to migrate (transfer) to the recording paper 3.

The fixing unit 8 is disposed rearward (to the right in FIG. 2) of the image forming units 20 and the transfer unit 18 and downstream with respect to the paper-conveying direction. The fixing unit 8 includes a heating roller 28 and a pressure roller 29. The heating roller 28 is configured of a metal tube, the surface of which is coated with a release layer. The metal tube accommodates a halogen lamp that extends along the axis of the heating roller 28. The halogen lamp heats the surface of the heating roller 28 to a fixing temperature. The pressure roller 29 is disposed in confrontation with the heating roller 28 for applying pressure thereto.

(3) Discharge Unit

The discharge unit 6 is disposed in an upper section of the main casing 5 downstream of the fixing unit 8 in the paper-conveying direction. The discharge unit 6 includes a pair of discharge rollers 31 fox discharging the recording paper 3 from the main casing 5 after the recording paper 3 has undergone the fixing operation, and a discharge tray 30 formed on top of the main casing 5 downstream of the discharge rollers 31 for receiving recording paper 3 in a stacked state after the recording paper 3 has undergone all steps in the image forming process.

2. Structure for Preventing Pre-Transfer

In the present embodiment, each of the transfer rollers 27 is offset (shifted) downstream in the paper-conveying direction from a position directly beneath the respective photosensitive drum 16. Accordingly, each corresponding photosensitive drum 16 and transfer roller 27 contact each other with pressure in a direction slanted with respect to the vertical direction (the vertical direction being a direction orthogonal to the direction in which the image forming units 20 are aligned or to the conveying direction of the recording paper 3). In other words, an axis 16*a* of the photosensitive drum 16 and an axis 27*a* of the transfer roller 27 are aligned at a slope to the vertical direction and, hence, the photosensitive drum 16 and transfer roller 27 apply pressure to each other in the direction of the slope.

With this configuration, as shown in FIG. 2, the photosensitive drum 16 in each set of photosensitive drums 16 and transfer rollers 27 contacts the conveying belt 15 earlier than the respective transfer roller 27. In other words, the photosensitive drum 16 starts contacting the conveying belt 15 at a position farther upstream than a position at which the transfer roller 27 starts contacting the conveying belt 15.

Note that, in FIG. 2, it looks like both of the photosensitive drum 16K and transfer roller 27K starts contacting the conveying belt 15 at the contact start position X. In the actual construction, however, only the photosensitive drum 16K starts contacting the conveying belt 15 at the contact start position X, and the transfer roller 27K has not yet contacted the conveying belt 15 at the contact start position X (see FIG. 1B). By allowing the conveying belt 15 and recording paper 3 to contact the photosensitive drum 16 prior to contacting the transfer roller 27, it is possible to suppress the scattering of developer caused by the electric field produced in the transfer roller 27 and to thereby prevent pre-transfer (see FIG. 1B).

As shown in FIG. 2, the amount of horizontal offset (the amount of horizontal shift) between the axis 27*a* of the transfer roller 27 and the axis 16*a* of the photosensitive drum 16 is denoted by d1 for the photosensitive drum 16Y and transfer roller 27Y disposed farthest upstream, d2 for the photosensitive drum 16M and transfer roller 27M disposed downstream thereof, d3 for the photosensitive drum 16C and transfer roller 27C disposed further downstream thereof, and d4 for the photosensitive drum 16K and transfer roller 27K disposed farthest downstream. The relationship of these offsets is shown in the following expression.

d4>d1, d2, and d3 (wherein d1, d2, and d3 may be the same or different from one another)

Here, a contact distance (or nip distance) is defined for each set of the photosensitive drum 16 and transfer roller 27. The contact distance is a distance from a contact start position X at which the photosensitive drum 16 starts contacting the conveying belt 15 or the recording paper 3 to a contact end position Y at which the photosensitive drum 16 separates from the conveying belt 15 or the recording paper 3. The contact distance is greatest for the photosensitive drum 16K and transfer roller 27K disposed farthest downstream. Therefore, the degree of pre-transfer suppression is greatest between the photosensitive drum 16K and transfer roller 27K farthest downstream.

As described above, in the present embodiment, each set of the photosensitive drum 16 and transfer roller 27 other than the farthest downstream set (the photosensitive drum 16K and transfer roller 27K) has horizontal offsets d1, d2, and d3. Accordingly, each set of the photosensitive drum 16 and transfer roller 27 other than the farthest downstream set has the contact distance greater than zero.

In addition, a belt section 15*a* of the conveying belt 15 farther downstream than the photosensitive drum 16K and transfer roller 27K is designed to follow a tangent to the photosensitive drum 16K and transfer roller 27K at the contact end position Y (indicated by a two-dot chain line L in FIG. 2). More specifically, the drive roller 25 is disposed so that the top surface thereof is positioned higher than the contact end position Y of the photosensitive drum 16K and transfer roller 27K. This configuration can be achieved by positioning the drive roller 25 higher than the follow roller 26 when both have the same diameter, for example.

The fixing unit 8 is also configured so that a nip point Z of the heating roller 28 and pressure roller 29 is positioned along an extended line of the belt section 15*a* (on the two-dot chain line L).

3. Effects of the Present Embodiment (1) Developer K transferred farthest downstream of all developer colors is often transferred on top of developer previously transferred onto the conveying belt 15 or the recording paper 3. Therefore, the printer 1 according to the first embodiment applies a larger transfer current to the transfer roller 27K farthest downstream than to the other transfer rollers 27 (27Y, 27M, and 27C). Accordingly, the offset d4 of the photosensitive drum 16K and transfer roller 27K farthest downstream is the largest of the offsets to maximize pre-transfer suppression. However, by increasing offset to enhance the capacity to suppress pre-transfer, the conveying belt 15 and the recording paper 3 are forced to curve sharper between the photosensitive drum 16 and transfer roller 27.

Here, the probability of pre-transfer occurring in the upstream photosensitive drums 16 and transfer roller 27 for yellow, magenta, and cyan is low. Therefore, the offsets d1-d3 in the present embodiment are minimized to reduce the curvature of the conveying belt 15 and the recording paper 3. This configuration can effectively suppress pre-transfer and can ensure that the conveying belt 15 and recording paper 3 are conveyed smoothly, compared with the configuration having the same amount of offset for all sets of photosensitive drums 16 and transfer rollers 27.

(2) After passing through the contact end position Y of the photosensitive drum 16K and transfer roller 27K farthest downstream, the recording paper 3 is conveyed along a tangent to the photosensitive drum 16K and transfer roller 27K at the contact end position Y (the two-dot chain line L) on the belt section 15*a* and in the fixing unit 8. Therefore, the recording paper 3 can be conveyed smoothly.

(3) Further, since most color images, such as natural images, are normally formed through composites of magenta, yellow, and cyan developer colors in halftones rather than using single colors of developer, the influence of pre-transfer is generally not noticeable in color images. However, in monochrome images and the like in which black developer is more frequently used, the effects of pre-transfer are more pronounced as the difference between dark and light regions is striking. Hence, in the present embodiment, black developer is transferred onto the recording paper 3 at the position farthest downstream, while developer colors other than black are transferred farther upstream.

(4) Further, pre-transfer can be suppressed through a relatively simple construction of offsetting the transfer rollers 27 with respect to the photosensitive drums 16.

Second Embodiment

Figure 3:
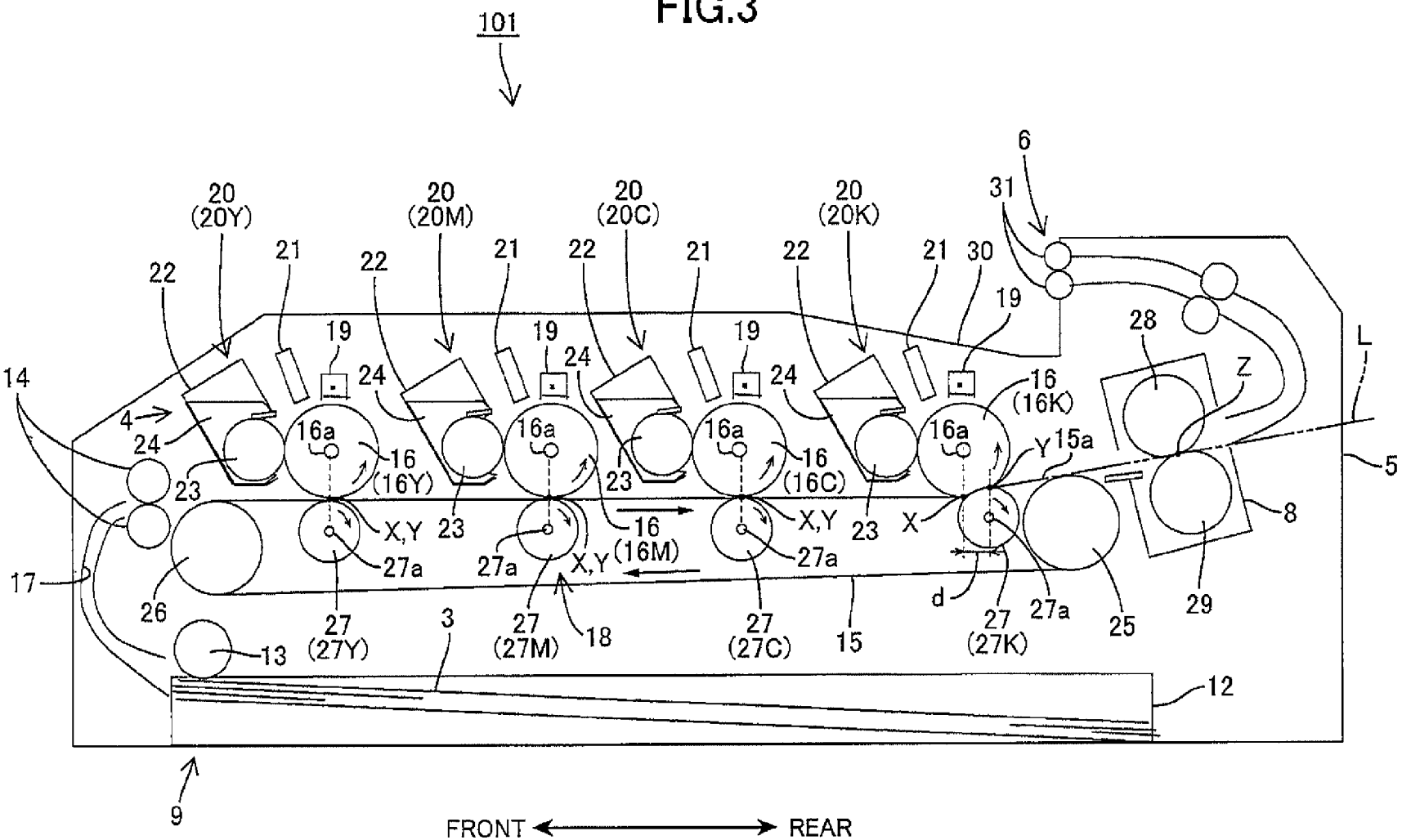
FIG. 3 is a vertical cross-sectional view of a printer according to a second embodiment of the invention.

FIG. 3 is a vertical cross-sectional view of a printer 101 according to a second embodiment. The printer 101 according to the second embodiment differs from the printer 1 according to the first embodiment in the amount of offset between the photosensitive drums 16 and transfer rollers 27. Since the remaining structure of the printer 101 is identical to the printer 1 in the first embodiment, like parts and components are designated with the same reference numerals to avoid duplicating description.

As shown in FIG. 3, no horizontal offset is provided between the photosensitive drums 16Y, 16M, and 16C and the respective transfer rollers 27Y, 27M, and 27C, that is, the axis 16*a* and axis 27*a* of all photosensitive drums 16 and transfer rollers 27 other than the photosensitive drum 16K and transfer roller 27K disposed farthest downstream are aligned vertically. Thus, in the present embodiment, each set of the photosensitive drum 16 and transfer roller 27 other than the farthest downstream set has the contact distance substantially equal to zero.

Accordingly, in the present embodiment, the photosensitive drum 16K of the farthest downstream set starts contacting the conveying belt 15 at a position farther upstream than a position at which the transfer roller 27K of the farthest downstream set starts contacting the conveying belt 15. On the other hand, the other photosensitive drums 16Y, 16M, and 16C start contacting the conveying belt 15 at positions equivalent to positions at which the corresponding transfer rollers 27Y, 27M, and 27C starts contacting the conveying belt 15.

Therefore, the printer 101 in the second embodiment gives priority to the smooth conveyance of the conveying belt 15 and recording paper 3 by not horizontally offsetting the photosensitive drums 16 and respective transfer roller 27, except the photosensitive drum 16K and transfer roller 27K. This configuration is particularly effective when the effects of pre-transfer for magenta, yellow, and cyan are essentially nonexistent, for example. However, horizontal offset is provided between the photosensitive drum 16K and transfer roller 27K farthest downstream since the effects of pre-transfer are apparent between the photosensitive drum 16K and transfer roller 27K farthest downstream.

Accordingly, in the printer 101 in the second embodiment, the contact distances of the photosensitive drums 16Y, 16M, and 16C and the respective transfer rollers 27Y, 27M, and 27C are set to substantially zero. That is, the contact start position is identical to the contact end position. Thus, the printer 101 of the present embodiment suppresses pre-transfer and facilitates smooth conveyance of the transfer medium (the conveying belt 15 and recording paper 3).

Third Embodiment

Figure 4:
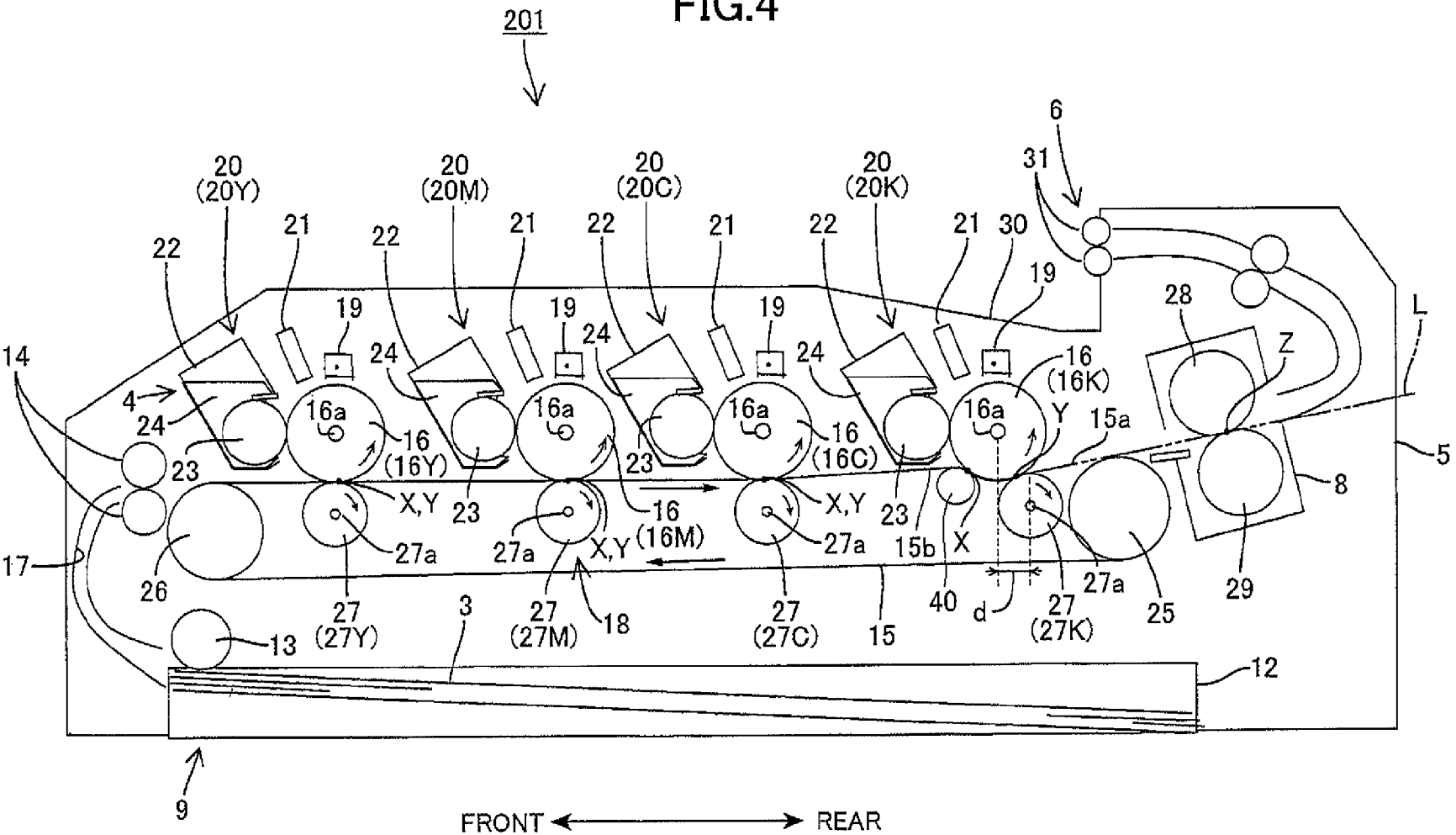
FIG. 4 is a vertical cross-sectional view of a printer according to a third embodiment of the invention.

FIG. 4 is a vertical cross-sectional view of a printer 201 according to a third embodiment. The printer 201 according to the third embodiment differs from the printer 1 according to the first embodiment in the construction for increasing the contact distance. Since the remaining structure of the printer 201 is identical to the printer 1 in the first embodiment, like parts and components are designated with the same reference numerals to avoid duplicating description.

As shown in FIG. 4, the photosensitive drums 16 are all aligned along the horizontal direction (front-to-rear direction). The printer 201 also includes a lifting roller (shifting member) 40 disposed on the lower upstream side of the photosensitive drum 16K. The lifting roller 40 lifts (pushes up) a section 15*b* of the conveying belt 15 just upstream of the photosensitive drum 16K to a height above the positions at which the photosensitive drums 16Y, 16M, and 16C confront the respective transfer rollers 27Y, 27M, and 27C. This configuration increases the contact distance between the contact start position X and the contact end position Y of the photosensitive drum 16K and transfer roller 27K. Further, since the lifting roller 40 is rotated through contact with the conveying belt 15, the lifting roller 40 applies little resistance to conveyance. In addition, the transfer roller 27K is offset (shifted) downstream from a position directly below the photosensitive drum 16K by an offset amount (shift amount) d, thereby further increasing the contact distance.

Fourth Embodiment

Figure 5:
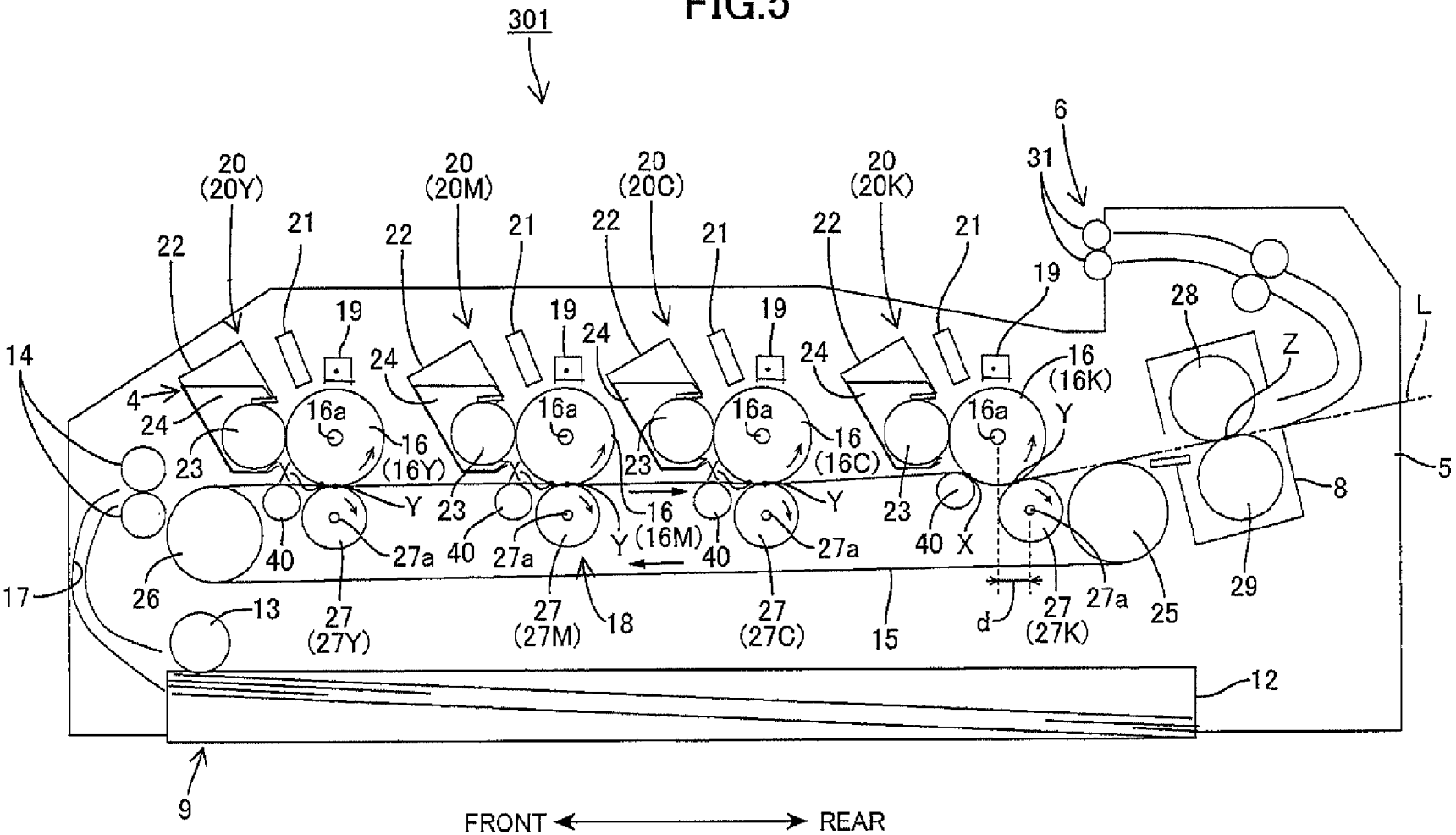
FIG. 5 is a vertical cross-sectional view of a printer according to a fourth embodiment of the invention.

FIG. 5 is a vertical cross-sectional view of a printer 301 according to a fourth embodiment. The printer 301 according to the fourth embodiment differs from the printer 201 according to the third embodiment by the number and position of the lifting rollers 40. Since the remaining structure of the printer 301 is identical to the printer 201 in the third embodiment, like parts and components are designated with the same reference numerals to avoid duplicating description.

As shown in FIG. 5, the lifting roller 40 described in the third embodiment is also disposed on the underside of the conveying belt 15 at positions upstream of each of the photosensitive drums 16Y, 16M, and 16C and transfer rollers 27Y, 27M, and 27C. However, these lifting rollers 40 lift the conveying belt 15 by a smaller amount than the lifting roller 40 farthest downstream (where the lifting amount is the height of the top surface of the lifting roller 40 in relation to the bottom surface of the photosensitive drum 16) This construction can suppress pre-transfer between the photosensitive drums 16Y, 16M, and 16C and the respective transfer rollers 27Y, 27M, and 27C, as well as the photosensitive drum 16K and transfer roller 27K.

Fifth Embodiment

Figure 6:
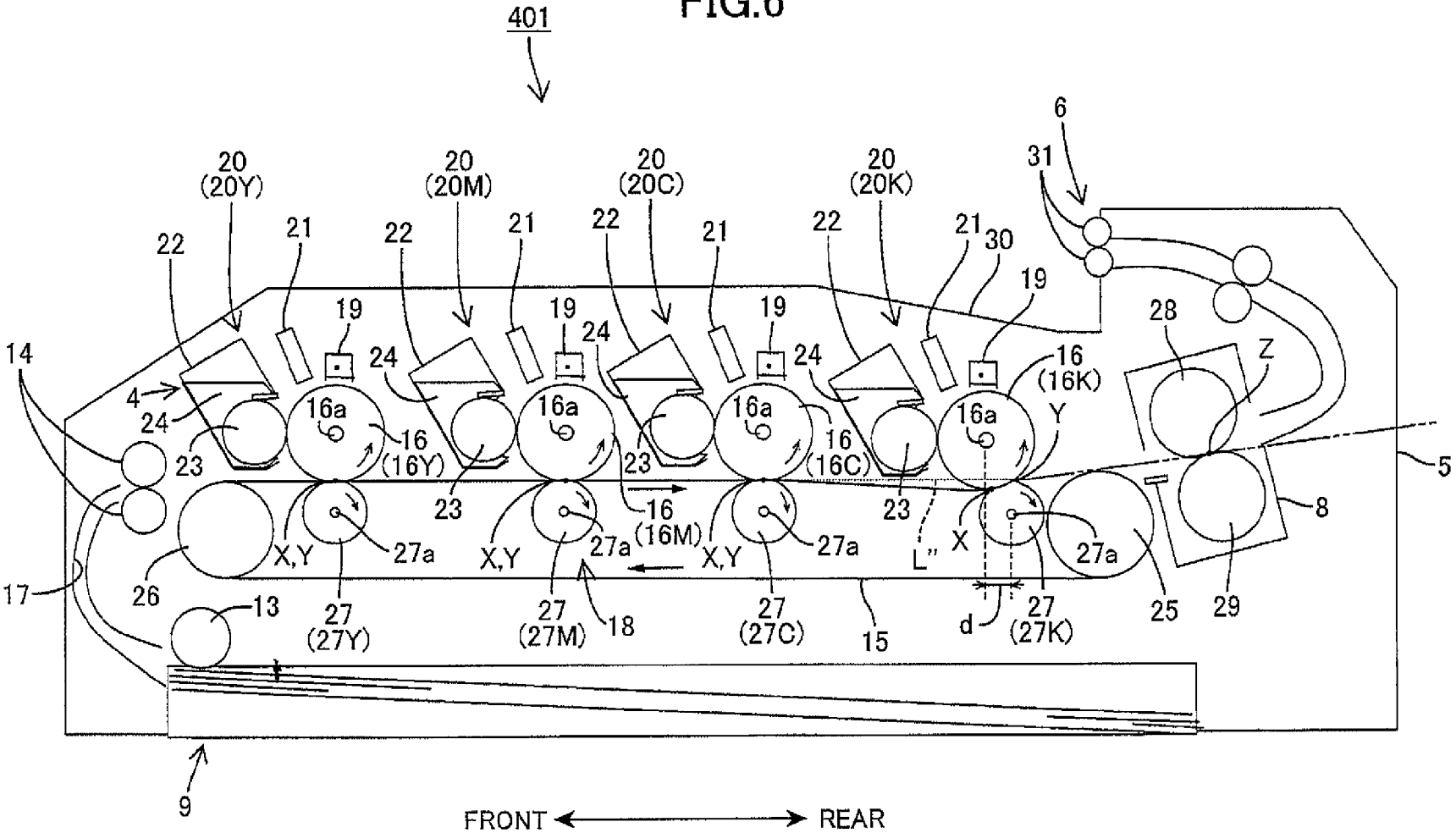
FIG. 6 is a vertical cross-sectional view of a printer according to a fifth embodiment of the invention.

FIG. 6 is a vertical cross-sectional view of a printer 401 according to a fifth embodiment. The printer 401 according to the fifth embodiment differs from the printer 1 according to the first embodiment in the construction for increasing the contact distance. Since the remaining structure of the printer 401 is identical to the printer 1 in the first embodiment, like parts and components are designated with the same reference numerals to avoid duplicating description.

As shown in FIG. 6, the photosensitive drum 16K on the farthest downstream side is disposed such that the lower surface of the photosensitive drum 16K is positioned lower than the lower surfaces of the other photosensitive drums 16Y, 16M, and 16C (denoted by a horizontal line L"). In other words, the photosensitive drum 16K is shifted vertically toward the transfer roller 27 side. This construction increases the contact distance between the contact start position X and the contact end position Y of the photosensitive drum 16K and transfer roller 27K. The contact distance can be further increased in the present embodiment by offsetting (shifting) the transfer roller 27K downstream from a position directly beneath the photosensitive drum 16K by a distance d.

<Modifications>

While the invention has been described in detail with reference to the above aspects thereof, it would be apparent to those skilled in the art that various changes and modifications may be made therein without departing from the spirit of the invention.

(1) For example, while a four-color laser printer employing black, cyan, magenta, and yellow colors is described in the above-described embodiments, laser printers may employ a different number of colors, such as six colors or two colors.

(2) In some image forming apparatuses, the density of developer is detected by transferring a developer image for a predetermined pattern on the conveying belt 15. However, if pre-transfer occurs at this time, it is not possible to accurately detect the density. Accordingly, the invention is also effective when the transfer medium is the conveying belt 15, as well as when the transfer medium is the recording paper 3.

(3) In the above-described embodiments, the developing roller 23 collects residual developer from each of the photosensitive drums 16 according to a simultaneous developing/cleaning system that does not require a separate cleaner. With this system, the developing roller 23 can only supply an amount of developer to the photosensitive drum 16 that corresponds to the developer recovery capacity of the developing roller 23. In other words, the developing roller 23 cannot sufficiently recover the residual developer if a large amount of developer is supplied in order to reduce the effects of pre-transfer. Accordingly, the invention is particularly suitable for image forming apparatuses that cannot increase the amount of developer supplied to the photosensitive drums.

(4) While the lifting rollers 40 in the third and fourth embodiments described above are rotatably disposed, non-rotatable lifting members may be used instead.

(5) In the third through fifth embodiments, the transfer roller 27K is offset downstream of the photosensitive drum 16K. However, the transfer roller 27K need not be offset downstream of the photosensitive drum 16K.

(6) In the above-described embodiments, the photosensitive drum 16 and transfer roller 27 disposed farthest downstream are configured to transfer black developer images. However, these components may be configured to transfer developer of a different color from black, although the configurations in the above-described embodiments are preferable since the effects of pre-transfer are particularly noticeable with black developer.

(7) The above-described embodiments describe a direct tandem system for sequentially transferring developer images in each color onto a recording paper 3 that is conveyed along the conveying belt 15. However, the invention may also be applied to an intermediate transfer tandem system for first transferring developer images in each color onto an intermediate transfer belt (primary transfer) and subsequently transferring all images at once onto a recording paper (secondary transfer), or to a tandem system in which the plurality of image forming units are arranged in a vertical stack or a tandem system in which the conveyor belt or intermediate transfer belt is slanted to the vertical direction. Any of these systems can be configured to achieve the same operations and effects as the above-described embodiments, provided that the photosensitive drum side is defined as being above and the transfer roller side as being below the conveying belt or the intermediate transfer belt.

(8) In the above-described embodiments, the transfer rollers 27 are used as the transfer member. However, a non-rotating member such as a brush may also be used as the transfer member.

(9) In the above-described embodiments, a sheet of paper is used as the transfer medium. However, other kinds of sheet materials such as a transparency sheet may also be used.

(10) In the above-described embodiments, the printers 1, 101, 201, 301, and 401 are described as examples of the image forming apparatus. However, the image forming apparatus may be a facsimile apparatus, or a multifunction apparatus having various functions such as a printer function and a scanner function.

What is claimed is:

1. An image forming apparatus comprising:

an apparatus main body;

a conveying member that conveys a recording medium; and a plurality of sets each including a cylindrical photosensitive member and a transfer member, the plurality of sets being disposed in a linear arrangement in the apparatus main body, the photosensitive member and the transfer member of each set sequentially interposing the conveying member therebetween, thereby sequentially transferring a developer image borne on each photosensitive member onto the recording medium conveyed by the conveying member; and a fixing unit including a heating roller and a pressure roller, the heating roller and the pressure roller defining a nip portion through which the recording medium passes, the fixing unit fixing the developer image transferred by the plurality of sets onto the recording medium, wherein a contact distance is defined for each set, the contact distance being a distance from a contact start position at which the photosensitive member starts contacting one of the conveying member and the recording medium to a contact end position at which the photosensitive member separates from the one of the conveying member and the recording medium;

wherein the contact distance is greatest for the set farthest downstream in a conveying direction for conveying the recording medium, wherein the transfer member of the farthest downstream set is disposed at a position shifted downstream of the photosensitive member in the conveying direction, thereby increasing the contact distance, and wherein a downstream conveying path for conveying the recording medium farther downstream from the farthest downstream set to the fixing unit is slanted toward the photosensitive member side with respect to the linear arrangement of the plurality of sets, the downstream conveying path extending from the contact end position of the farthest downstream set to the nip portion of the fixing unit.

2. The image forming apparatus according to claim 1, wherein the conveying member is an endless belt.

3. The image forming apparatus according to claim 1, wherein each set other than the farthest downstream set has the contact distance greater than zero.

4. The image forming apparatus according to claim 1, wherein each set other than the farthest downstream set has the contact distance substantially equal to zero.

5. The image forming apparatus according to claim 1, further comprising a shifting member that shifts a conveying path immediately upstream of the farthest downstream set toward the photosensitive member side with respect to the linear arrangement of the plurality of sets, thereby increasing the contact distance.

6. The image forming apparatus according to claim 1, wherein the photosensitive member and the transfer member of the farthest downstream set are disposed at positions shifted toward the transfer member side with respect to the linear arrangement of the plurality of sets, thereby increasing the contact distance.

7. The image forming apparatus according to claim 1, wherein the photosensitive member of the farthest downstream set bears a developer image with black developer.

8. The image forming apparatus according to claim 1, further comprising a developer supplying member provided for each photosensitive member, each developer supplying member supplying developer to a corresponding photosensitive member and recovering developer deposited on the corresponding photosensitive member.

9. The image forming apparatus according to claim 1, wherein the photosensitive member of the farthest downstream set starts contacting one of the recording medium and the conveying member at a position farther upstream than a position at which the transfer member of the farthest downstream set starts contacting the conveying member.

10. The image forming apparatus according to claim 9, wherein the photosensitive member of each set other than the farthest downstream set starts contacting one of the recording medium and the conveying member at a position farther upstream than a position at which a corresponding transfer member starts contacting the conveying member.

* * * * *